US010513764B2

(12) United States Patent
Leistner et al.

(10) Patent No.: US 10,513,764 B2
(45) **Date of Patent: *Dec. 24, 2019**

(54) REDUCED COST STEEL FOR HYDROGEN TECHNOLOGY WITH HIGH RESISTANCE TO HYDROGEN-INDUCED EMBRITTLEMENT

(71) Applicant: Bayerische Motoren Werke Aktiengesellschaft, Munich (DE)

(72) Inventors: Wolfgang Leistner, Munich (DE); Thorsten Michler, Wiesbaden (DE); Werner Theisen, Hattingen (DE); Mauro Sebastian Martin, Bochum (DE); Sebastian Weber, Essen (DE); Joerg Naumann, Neufahrn (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 157 days.

This patent is subject to a terminal disclaimer.

(21) Appl. No.: 14/541,420

(22) Filed: Nov. 14, 2014

(65) Prior Publication Data

US 2015/0167134 A1 Jun. 18, 2015

Related U.S. Application Data

(63) Continuation of application No. PCT/EP2013/060084, filed on May 15, 2013.

(30) Foreign Application Priority Data

May 16, 2012 (DE) ..... 10 2012 104 260

(51) Int. Cl.

| | |
|---|---|
| ***C21D 6/00*** | (2006.01) |
| ***C22C 38/58*** | (2006.01) |
| ***C22C 38/00*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/48*** | (2006.01) |
| ***C22C 38/54*** | (2006.01) |

(52) U.S. Cl.

CPC ..... *C22C 38/58* (2013.01); *C21D 6/001* (2013.01); *C21D 6/005* (2013.01); *C22C 38/001* (2013.01); *C22C 38/06* (2013.01); *C22C 38/34* (2013.01); *C22C 38/42* (2013.01); *C22C 38/44* (2013.01); *C22C 38/48* (2013.01); *C22C 38/54* (2013.01); *C21D 2211/001* (2013.01)

(58) Field of Classification Search

CPC ..... C22C 38/001; C22C 38/005; C22C 38/02; C22C 38/04; C22C 38/06; C22C 38/34; C22C 38/42; C22C 38/44; C22C 38/48; C22C 38/54; C22C 38/58; C21D 6/001; C21D 6/005; C21D 2211/001

USPC ..... 420/57

See application file for complete search history.

(56) References Cited

U.S. PATENT DOCUMENTS

| | | | | |
|---|---|---|---|---|
| 7,749,431 | B2 * | 7/2010 | Igarashi | C22C 38/001 148/326 |
| 8,303,733 | B2 * | 11/2012 | Hamada | C21D 6/002 148/325 |
| 2008/0292489 | A1 | 11/2008 | Yamamoto et al. | |
| 2011/0250522 | A1 * | 10/2011 | Kaminaka | C22C 38/40 429/479 |
| 2013/0174949 | A1 * | 7/2013 | Hatano | C21D 6/004 148/609 |

FOREIGN PATENT DOCUMENTS

| | | | | |
|---|---|---|---|---|
| EP | 1 645 649 | A1 | 4/2006 | |
| FR | 743 179 | A | 3/1933 | |
| GB | 2 073 249 | A | 10/1981 | |
| JP | WO 2010041694 | A1 * | 4/2010 | C22C 38/40 |
| WO | WO-2012043877 | A1 * | 4/2012 | C21D 6/004 |

OTHER PUBLICATIONS

International Search Report (PCT/ISA/210) dated Sep. 30, 2013 with English-language translation (Six (6) Pages).

Weber, S., M. Martin, and W. Theisen. "Lean-alloyed Austenitic Stainless Steel with High Resistance against Hydrogen Environment Embrittlement." *Materials Science and Engineering A* 528 (2011): 7688-7695.

Fukuyama et al. "Effect of Temperature on Hydrogen Environment Embrittlement of Type 316 Series Austenitic Stainless Steel at Low Temperatures" *J. Japan Inst. Metals*, vol. 67, No. 9 (2003), pp. 456-459.

* cited by examiner

*Primary Examiner* — Jie Yang

(74) *Attorney, Agent, or Firm* — Crowell & Moring LLP

(57) ABSTRACT

An austenitic steel for hydrogen technology has the following composition:

0.01 to 0.4 percent by mass of carbon,
≤5 percent by mass of silicon,
0.3 to 30 percent by mass of manganese,
10.5 to 30 percent by mass of chromium,
4 to 12.5 percent by mass of nickel,
≤3 percent by mass of molybdenum,
≤0.2 percent by mass of nitrogen,
≤5 percent by mass of aluminum,
≤5 percent by mass of copper,
≤5 percent by mass of tungsten,
≤0.1 percent by mass of boron,
≤3 percent by mass of cobalt,
≤0.5 percent by mass of tantalum,
≤2.0 percent by mass of at least one of the elements: niobium, titanium, vanadium, hafnium and zirconium,
≤0.3 percent by mass of at least one of the elements: yttrium, scandium, lanthanum, cerium and neodymium,
the remainder being iron and smelting-related steel companion elements.

8 Claims, No Drawings

REDUCED COST STEEL FOR HYDROGEN TECHNOLOGY WITH HIGH RESISTANCE TO HYDROGEN-INDUCED EMBRITTLEMENT

CROSS REFERENCE TO RELATED APPLICATIONS

This application is a continuation of PCT International Application No. PCT/EP2013/060084, filed May 15, 2013, which claims priority under 35 U.S.C. § 119 from German Patent Application No. 10 2012 104 260.8, filed May 16, 2012, the entire disclosures of which are herein expressly incorporated by reference.

BACKGROUND OF THE INVENTION

The invention relates to an austenitic corrosion-resistant steel with high resistance to hydrogen-induced embrittlement over the entire temperature range (−253° C. to at least +100° C.), in particular between −100° C. and room temperature (+25° C.). The proposed steel is suited for all metallic components which are in contact with hydrogen such as, for example, hydrogen tanks, valves, pipes, fittings, bosses, liners, springs, heat exchangers or bellows.

Steel which is exposed to mechanical stress in a hydrogen atmosphere over a longer period of time is subjected to hydrogen embrittlement. Austenitic stainless steels with high nickel content such as material no. 1.4435, X2CrNiMo18-14-3 constitute an exception. In case of such austenitic steels, a nickel content of at least 12.5 percent by mass is considered to be necessary in order to achieve sufficient resistance to hydrogen embrittlement over the entire temperature range from −253° C. to at least +100° C. and pressure range from 0.1 to 100 MPa. However, like molybdenum, nickel is a very expensive alloying element so that cost-effective, hydrogen-resistant steels are especially missing for the mass production of, for example, tank components in the motor vehicle sector.

It is therefore the object of the invention to provide a cost effective steel which is resistant to hydrogen-induced embrittlement over the entire temperature range, in particular in the range of maximum hydrogen embrittlement between room temperature and −100° C., which is resistant to corrosion and which has good hot and cold forming and welding capabilities.

SUMMARY OF THE INVENTION

According to the invention, this is achieved with an austenitic steel having the following composition:

- 0.01 to 0.4 percent by mass, in particular at least 0.05 percent by mass of carbon,
- ≤5 percent by mass, in particular 0.5 to 3.5 percent by mass of silicon,
- 0.3 to 30 percent by mass, preferably 4 to 20 percent by mass, and in particular 6 to 15 percent by mass of manganese,
- 10.5 to 30 percent by mass, preferably 10.5 to 22 percent by mass, and in particular 20 percent by mass of chromium,
- 4 to 12.5 percent by mass, preferably 5 to 10 percent by mass, and in particular at most 9 percent by mass of nickel,
- ≤3 percent by mass, in particular at most 2.5 percent by mass of molybdenum,

- ≤0.2 percent by mass, in particular ≤0.08 percent by mass of nitrogen,
- ≤5 percent by mass, preferably ≤1.0 percent by mass, and in particular at most 0.5 percent by mass of aluminum,
- ≤5 percent by mass of copper, in particular at least 1 percent by mass of copper,
- ≤4 percent by mass, preferably at most 3 percent by mass, and in particular 0.5 to 2.5 percent by mass of tungsten,
- ≤0.1 percent by mass, preferably at most 0.05 percent by mass of boron,
- ≤3 percent by mass, in particular ≤2.0 percent by mass of cobalt,
- ≤0.5 percent by mass, in particular ≤0.3 percent by mass of tantalum,
- ≤2.0 percent by mass, preferably ≤1.5 percent by mass of at least one of the elements: niobium, titanium, vanadium, hafnium and zirconium,
- ≤0.3 percent by mass, preferably 0.01 to 0.2 percent by mass of at least one of the elements yttrium, scandium, lanthanum, cerium and neodymium, the remainder being iron and smelting-related steel companion elements.

DETAILED DESCRIPTION OF THE INVENTION

According to the invention, an austenitic steel has the following composition:

- 0.01 to 0.4 percent by mass, in particular at least 0.05 percent by mass of carbon,
- ≤5 percent by mass, in particular 0.5 to 3.5 percent by mass of silicon,
- 0.3 to 30 percent by mass, preferably 4 to 20 percent by mass, and in particular 6 to 15 percent by mass of manganese,
- 10.5 to 30 percent by mass, preferably 10.5 to 22 percent by mass, and in particular 20 percent by mass of chromium,
- 4 to 12.5 percent by mass, preferably 5 to 10 percent by mass, and in particular at most 9 percent by mass of nickel,
- ≤3 percent by mass, in particular at most 2.5 percent by mass of molybdenum,
- ≤0.2 percent by mass, in particular ≤0.08 percent by mass of nitrogen,
- ≤5 percent by mass, preferably ≤1.0 percent by mass, and in particular at most 0.5 percent by mass of aluminum,
- ≤5 percent by mass of copper, in particular at least 1 percent by mass of copper,
- ≤4 percent by mass, preferably at most 3 percent by mass, and in particular 0.5 to 2.5 percent by mass of tungsten,
- ≤0.1 percent by mass, preferably at most 0.05 percent by mass of boron,
- ≤3 percent by mass, in particular ≤2.0 percent by mass of cobalt,
- ≤0.5 percent by mass, in particular ≤0.3 percent by mass of tantalum,
- ≤2.0 percent by mass, preferably ≤1.5 percent by mass of at least one of the elements: niobium, titanium, vanadium, hafnium and zirconium,
- ≤0.3 percent by mass, preferably 0.01 to 0.2 percent by mass of at least one of the elements yttrium, scandium, lanthanum, cerium and neodymium, the remainder being iron and smelting-related steel companion elements.

The steel according to the invention can be produced with or without the addition of molybdenum. If molybdenum is added, the molybdenum content of the steel can, for example, be 0.5 to 3 percent by mass. That is to say that it can contain up to 0.3 percent by mass of aluminum as a smelting-related steel companion element. The same applies to nitrogen. In addition, molybdenum can be contained in the steel only as a smelting-related steel companion element.

The smelting-related steel companion elements comprise further conventional production-related elements (e.g. sulfur and phosphorus) as well as further nonspecifically alloyed elements. Preferably, the phosphorus content is <0.05 percent by mass, the sulfur content ≤0.4 percent by mass, in particular ≤0.04 percent by mass. The content of all smelting-related steel companion elements is at most 0.3 percent by mass per element.

Among the micro-alloying elements, (a) yttrium, scandium, lanthanum, cerium and (b) zirconium and hafnium are of particular relevance.

The alloy according to the invention may have an yttrium content of 0.01 to 0.2 percent by mass, in particular to 0.10 percent by mass, wherein yttrium can fully or partly be replaced by one of the elements scandium, lanthanum or cerium. Preferably, the hafnium content and the zirconium content are in each case 0.01 to 0.2 percent by mass, in particular to 0.10 percent by mass, wherein hafnium or zirconium can fully or partly be replaced by 0.01 to 0.2 percent by mass, in particular to 0.10 percent by mass of titanium.

Due to the reduction of the nickel content to 4 to 12.5 percent by mass, in particular at most 9 percent by mass, and the low or even missing molybdenum content, the costs of the alloy according to the invention can be reduced.

Despite the reduction of the nickel content and the low molybdenum content or the absence of molybdenum (i.e. without the addition of molybdenum), the steel according to the invention has very good mechanical properties in a hydrogen atmosphere over the entire temperature range from −253° C. to at least +100° C. and pressure range from 0.1 to 100 MPa.

For example; in a tensile test carried out at a test temperature of −50° C., a gas pressure of hydrogen of 40 MPa and a strain rate of 5×10-5 l/s, the steel according to the invention has, in the solution-annealed condition, a relative reduction area (RRA) (=reduction of area Z in air or helium/reduction of area Z in hydrogen×100%) of at least 90%. The corresponding relative tensile strength R_Rm, relative yield strength R_Rp0.2 and relative elongation at break R_A5 are likewise at least 90%. In addition, the high yield strength of the steel from 300 to 400 MPa is of significant importance.

The steel according to the invention may be solution annealed (AT). In addition, it can be used when being cold formed, in particular cold drawn or cold rolled.

The steel provides very good weldability as well as good resistance to corrosion.

The steel according to the invention has a high resistance to hydrogen embrittlement over the entire temperature range from −253° C. to at least +100° C. and pressure range from 0.1 to 100 MPa.

Thus, the steel according to the invention is a cost-effective, hydrogen-resistant material for use in hydrogen technology.

That is to say that the steel can be used for devices and components of systems for the generation, storage, distribution and application of hydrogen, in particular in cases where the devices and/or components come into contact with hydrogen. This applies, in particular, to pipes, control devices, valves and other shut-off devices, containers, fittings, bosses and liners, heat exchangers, pressure sensors, etc., including parts of said devices, for example springs and bellows.

The invention relates, in particular, to steels for hydrogen technology in motor vehicles. A (high-)pressure tank, a cryogenic (high-)pressure tank or a liquid hydrogen tank made of the steel according to the invention can be used for the storage of hydrogen.

In addition, the steel is suited for applications outside of motor vehicle technology which require excellent austenitic stability, in particular after cold forming.

The following steels according to the invention with the following composition (as a mass percentage):

Steel No. 1:
0.01 to 0.12% C
0.05 to 0.5% Si
9 to 13% Mn
16 to 20% Cr
6 to 9% Ni
1 to 4% Cu
0.01 to 0.5% Al
0 to 0.04% B,
the remainder being iron and smelting-related steel companion elements, Steel No. 2:
0.10 to 0.20% C
0.5 to 3.5% Si
8 to 12% Mn
11 to 15% Cr
6 to 9% Ni
1 to 4% Cu
0.5 to 2.5% W
0.01 to 0.5% Al,
the remainder being iron and smelting-related steel companion elements, have a stable austenitic structure. The δ-ferrite content of the steels is less than 5 percent by volume; preferably, δ ferrite is not even present. In the solution-annealed condition (AT), the yield strength Rp0.2 is 200 to 300 MPa for Steel No. 1 and 300 to 400 MPa for Steel No. 2 in a tensile test carried out at a strain rate of 5×10-5/s, a temperature of −50° C. and in a hydrogen atmosphere of 40 MPa. The relative reduction area (=reduction of area Z in helium divided by/reduction of area Z in hydrogen×100%) is more than 85% for both steels.

Due to the relatively low nickel content of at most 9 percent by mass and the absence of molybdenum, both steels are very cost-effective.

As shown in case of Steel No. 1, the steel according to the invention can also be tungsten-free.

Thus, the steel according to the invention having a stable austenitic structure is a cost-effective, hydrogen-resistant material for use in hydrogen technology.

The examples below showing steels according to the invention serve the purpose of further explaining the invention.

| | Example 1 | | Example 2 | |
|---|---|---|---|---|
| | nominal | actual | nominal | actual |
| C | 0.2 | 0.172 | 0.2 | 0.170 |
| Si | 2 | 2.1 | 2 | 2.1 |
| Mn | 10.5 | 10.2 | 10.5 | 10.2 |
| P | | 0.010 | | 0.005 |
| S | | 0.006 | | 0.011 |
| Cr | 13.7 | 13.4 | 13.7 | 13.7 |

-continued

| | Example 1 | | Example 2 | |
|---|---|---|---|---|
| | nominal | actual | nominal | actual |
| Ni | 8 | 7.9 | 8 | 7.9 |
| Mo | | 0.03 | 2 | 2.1 |
| N | | 0.058 | | 0.029 |
| Al | 0.1 | 0.2 | 0.1 | 0.1 |
| Cu | 3 | 3.2 | 3 | 3.1 |
| W | 2 | 1.69 | 2 | 1.8 |
| Nb | | 0.005 | 1 | 0.9 |
| δ-ferrite (%) (calculcated from analysis) | 0 | 0 | 0 | 0 |
| δ-ferrite (%) measured with Feritscope | — | 0 | — | 0 |
| Rm (MPa) air/H2 (at −50° C. 40 Mpa) | — | 767/821 | — | 789/855 |
| Rp0.2 (MPa) air/H2 (at −50° C. 40 Mpa) | — | 340/377 | — | 383/377 |
| yield strength ratio air/H2 (at −50° C. 40 Mpa) | — | 0.44 | — | 0.49 |
| A5(%) air/H2 (at −50° C. 40 Mpa) | — | 74/75 | — | 62/61 |
| Z(%) air/H2 (at −50° C. 40 Mpa) | — | 74/71 | — | 63/66 |
| RRA(%) (at −50° C. 40 Mpa) | — | 96 | — | 104 |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Austenitic steel for use in hydrogen technology in motor vehicles, comprising the following composition:

0.01 to 0.4 percent by mass of carbon;

≤5 percent by mass of silicon;

4 to 20 percent by mass of manganese;

10.5 to 30 percent by mass of chromium;

4 to 9 percent by mass of nickel;

≤2 percent by mass of molybdenum;

≤0.08 percent by mass of nitrogen;

at most 0.5 percent by mass of aluminum;

3.0 to 4.0 percent by mass of copper;

≤4 percent by mass of tungsten;

≤0.1 percent by mass of boron;

≤5 percent by mass of cobalt;

≤0.5 percent by mass of tantalum;

≤2.0 percent by mass of at least one of the elements: niobium, titanium, vanadium, hafnium and zirconium; and 0.01 to 0.2 percent by mass of yttrium, wherein yttrium can fully or partly be replaced by 0.01 to 0.2 percent by mass of scandium and/or lanthanum and/or cerium;

the remainder being iron and smelting-related steel companion elements, wherein the steel has a δ-ferrite content of less than 5 percent by volume, wherein the steel is resistant to hydrogen-induced embrittlement over the temperature range from −253° C. to at least +100° C., and wherein in a tensile test carried out at a test temperature of −50° C. and a gas pressure of hydrogen of 40 MPa, the steel has a relative reduction of area (RRA) of at least 90%, and a relative elongation at break (R_A5) of at least 90%.

2. The steel according to claim 1, wherein the molybdenum content is ≤0.40 percent by mass.

3. The steel according to claim 1, wherein the steel contains 3.5 percent by mass of tungsten.

4. The steel according to claim 1, wherein the steel contains 0.04 percent by mass of boron.

5. The steel according to claim 1, wherein the steel contains 0.01 to 0.2 percent by mass of hafnium and/or zirconium, wherein hafnium or zirconium can fully or partly be replaced by 0.01 to 0.2 percent by mass of titanium.

6. The steel according to claim 1, wherein the steel contains up to 0.3 percent by mass of tantalum.

7. The steel according to claim 1, wherein the steel contains up to 3.0 percent by mass of cobalt.

8. Austenitic steel for use in hydrogen technology in motor vehicles, comprising the following composition:

0.01 to 0.12 percent by mass of carbon;

0.05 to 0.5 percent by mass of silicon;

9 to 13 percent by mass of manganese;

16 to 20 percent by mass of chromium;

6 to 9 percent by mass of nickel;

3.0 to 4.0 percent by mass of copper;

0.01 to 0.5 percent by mass of aluminum;

0 to 0.04 percent by mass of boron;

≤0.08 percent by mass of nitrogen;

0.01 to 0.2 percent by mass of yttrium, wherein yttrium can fully or partly be replaced by 0.01 to 0.2 percent by mass of scandium and/or lanthanum and/or cerium;

the remainder being iron and smelting-related steel companion elements, wherein the steel has a δ-ferrite content of less than 5 percent by volume, wherein the steel is resistant to hydrogen-induced embrittlement over the temperature range from −253° C. to at least +100° C., and wherein in a tensile test carried out at a test temperature of −50° C. and a gas pressure of hydrogen of 40 MPa, the steel has a relative reduction of area (RRA) of at least 90%, and a relative elongation at break (R_A5) of at least 90%.

* * * * *